US007344481B2

(12) United States Patent
Watterson et al.

(10) Patent No.: US 7,344,481 B2
(45) Date of Patent: Mar. 18, 2008

(54) TREADMILL WITH MOVEABLE CONSOLE

(75) Inventors: Scott R. Watterson, Logan, UT (US); William T. Dalebout, North Logan, UT (US); Darren C. Ashby, Richmond, UT (US)

(73) Assignee: Icon IP, Inc., Logan, UT (US)

( * ) Notice: Subject to any disclaimer, the term of this patent is extended or adjusted under 35 U.S.C. 154(b) by 651 days.

(21) Appl. No.: 10/754,166

(22) Filed: Jan. 9, 2004

(65) Prior Publication Data

US 2005/0164838 A1 Jul. 28, 2005

(51) Int. Cl.

| | |
|---|---|
| ***A63B 22/02*** | (2006.01) |
| ***A63B 24/00*** | (2006.01) |
| ***A63B 71/00*** | (2006.01) |
| ***A63B 22/00*** | (2006.01) |
| ***A47D 13/04*** | (2006.01) |
| ***A61H 3/00*** | (2006.01) |

(52) U.S. Cl. ..... 482/54; 482/8; 482/4; 482/66

(58) Field of Classification Search ..... 482/54, 482/8, 51, 66

See application file for complete search history.

(56) References Cited

U.S. PATENT DOCUMENTS

| | | | | | |
|---|---|---|---|---|---|
| 4,708,337 | A | * | 11/1987 | Shyu | 482/54 |
| 4,976,424 | A | * | 12/1990 | Sargeant et al. | 482/6 |
| D318,699 | S | | 7/1991 | Jacobson et al. | D21/192 |
| D323,009 | S | | 1/1992 | Dalebout et al. | D21/192 |
| D323,198 | S | | 1/1992 | Dalebout et al. | D21/192 |
| D323,199 | S | | 1/1992 | Dalebout et al. | D21/192 |
| 5,102,380 | A | | 4/1992 | Jacobson et al. | 482/54 |
| 5,104,119 | A | | 4/1992 | Lynch | 482/5 |
| 5,145,481 | A | | 9/1992 | Friedebach | 482/70 |
| 5,277,678 | A | * | 1/1994 | Friedebach et al. | 482/70 |
| D344,557 | S | | 2/1994 | Ashby | D21/192 |
| 5,282,776 | A | | 2/1994 | Dalebout | 482/118 |
| D348,493 | S | | 7/1994 | Ashby | D21/192 |
| 5,336,145 | A | | 8/1994 | Keiser | 482/54 |
| D351,202 | S | | 10/1994 | Bingham | D21/192 |
| D351,633 | S | | 10/1994 | Bingham | D21/191 |
| 5,595,556 | A | | 1/1997 | Dalebout et al. | 482/54 |
| 5,645,509 | A | | 7/1997 | Brewer et al. | 482/4 |

(Continued)

OTHER PUBLICATIONS

Flex'nStride, *The Affordable Cross-Training Treadmill*, available on information and belief at least as early as Aug. 1993 (2 pages).

(Continued)

*Primary Examiner*—LoAn H. Thanh
(74) *Attorney, Agent, or Firm*—Workman Nydegger

(57) ABSTRACT

The present invention relates to exercise apparatuses. In more particular the present invention relates to a self-adjusting treadmill having a moveable console and a self-adjusting cushioning assembly. According to one aspect of the present invention, the moveable console and the self-adjusting cushioning assembly of the treadmill automatically adjust based on user parameters. The user parameters can be input by the user or automatically detected when the user steps on the treadmill by the movable console and/or the cushioning mechanisms. In one embodiment, when the user stands on the treadmill, the console detects the height of the user and is automatically raised or lowered to tailor the positioning of the console relative to the height of the user.

37 Claims, 10 Drawing Sheets

U.S. PATENT DOCUMENTS 5,771,152 A * 6/1998 Crompton et al. ..... 361/681
5,860,893 A 1/1999 Watterson et al. ..... 482/54
5,890,562 A * 4/1999 Bartels et al. ..... 187/224
D421,779 S 3/2000 Piaget et al. ..... D21/669
6,135,924 A * 10/2000 Gibbs et al. ..... 482/54
6,163,451 A * 12/2000 Chiu ..... 361/681
6,276,749 B1 * 8/2001 Okazawa et al. ..... 296/190.08
6,432,026 B1 8/2002 Wang et al. ..... 482/54
6,450,284 B1 * 9/2002 Sakyo et al. ..... 180/329
6,461,275 B1 10/2002 Wang et al. ..... 482/8
6,475,121 B2 11/2002 Wang et al. ..... 482/54

OTHER PUBLICATIONS

Pro-Form, *Cross Walk*, available on information and belief at least as early as Aug. 1993 (6 pages).
NordicTrack's Walk Fit, *The Wall Street Journal*, Aug. 1993 (1 page).

* cited by examiner

TREADMILL WITH MOVEABLE CONSOLE

BACKGROUND OF THE INVENTION

1. The Field of the Invention

The present invention relates to exercise apparatuses. In particular the present invention relates to a self-adjusting treadmill having a movable console and/or a self adjusting cushioning assembly.

2. The Relevant Technology

Exercise treadmills have long been a mainstay of the home and institutional exercise equipment market. One advantage of exercise treadmills is that they decrease the wear on a user's joints when the user is running or walking, as opposed to walking on a street, trail, or other hard and/or uneven surface. Exercise treadmills having adjustable features that allow tailoring of the exercise experience to an individual user have become more popular in recent years.

Exercise treadmills typically utilize a console having user interfaces to allow a user to view exercise program information and input or select different exercise program information or features. Such consoles typically allow a user some degree of interactivity and tailoring of treadmill features including speed, displayed information, and exercise program duration. The height of such consoles is typically set at an intermediate height so as to be usable by most users. However, the intermediate height of the console may not be optimal for many of the users who will utilize the treadmill. Manipulation of the controls, while possible for many users, may not be well tailored to any actual user of the treadmill. Additionally, the height of the console may not comport with a unusually tall or unusually short user.3

Another feature utilized with exercise treadmills are cushioning mechanisms. Cushioning mechanisms in treadmills provide alleviation from the impact experienced during user exercise. A variety of different types of cushioning mechanisms are available, ranging from elastomeric members placed between the deck and the frame of a treadmill to more complex mechanisms that involve adjustability of the amount of cushioning provided.

One drawback of many existing cushioning systems is that they are designed primarily to enable adjustment before or after a given exercise routine. Such systems can be difficult, if not impractical, to adjust during the course of the exercise routine. As a result it may not be possible to tailor the amount of cushioning to different users or to variable intensities experienced during a workout. For example, a user who begins exercising more intensely during a particular exercise routine may require more cushioning than the user would if the user were walking. In addition, a desirable amount of cushioning for one user, may not be suitable for another user.

BRIEF SUMMARY OF THE INVENTION

The present invention relates to exercise apparatuses. In more particular the present invention relates to a self-adjusting treadmill having a moveable console and a self-adjusting cushioning assembly. According to one aspect of the present invention, the moveable console and the self-adjusting cushioning assembly of the treadmill automatically adjust based on user parameters when the user steps on the treadmill. The user parameters can be input by the user or automatically detected by the movable console and/or the cushioning mechanism. For example, in one embodiment, when the user stands on the treadmill, the console detects the height of the user and automatically raises or lowers the console to tailor the positioning of the console relative to the height of the user. In another embodiment, when the user steps on the treadmill, the self-adjusting cushioning assembly detects the weight of the user and automatically adjusts the amount of cushioning provided to accommodate the weight of the user.

According to one aspect of the present invention, the moveable console includes a height sensor and a console height adjustment mechanism. The height sensor utilizes a light source, such as a laser, infrared (IR), or other source of light to determine the height of the user. Then the console height adjustment mechanism adjusts the height of the console such that the height of the console is tailored to the height of the user. In one embodiment, the console starts in a default position at its uppermost position. When the user steps on the treadmill, the height sensors are automatically activated and light is emitted from the height sensor. The angle of the light corresponds with a desired placement of the console relative to the height of the user. Where the height sensor detects little or no reflection of light from the user, the console height adjustment mechanism begins to lower the console. The height of the user is detected when the console is lowered to a position in which the light emitted from the height sensor contacts and reflects from the user. Based on the angle of the light emitted from the height sensor, the height of the user can be determined. Once the height of the user is detected the console height adjustment mechanism discontinues further downward movement of the console. This is because the console is in a desired height relative to the sensed height of the user. According to another embodiment of the present invention, the console starts at a default lowest position and is raised until reflection of the light is no longer detected.

The cushioning assembly is utilized in connection with a deck of the treadbase of treadmill. The cushioning assembly is adapted to absorb the impact of a user exercising on the treadbase. The cushioning assembly provides a variable amount of cushioning, thus allowing the deck to move a greater or lesser amount when the user is exercising on the treadbase. According to one aspect of the present invention, once the user steps on the treadbase a deflection sensor assembly of the cushioning assembly automatically detects the weight of the user. Based on the sensed weight of the user, the cushioning assembly is automatically adjusted to provide a desired amount of cushioning based on the weight of the user.

According to one embodiment of the present invention, a user can select a desired amount of cushioning. In this embodiment, the weight of the user is factored in with the selected amount of cushioning desired and the cushioning assembly is adjusted to provide the desired amount of cushioning based on the weight of the user.

These and other objects and features of the present invention will become more fully apparent from the following description and appended claims, or may be learned by the practice of the invention as set forth hereinafter.

BRIEF DESCRIPTION OF THE DRAWINGS

To further clarify the above and other advantages and features of the present invention, a more particular description of the invention will be rendered by reference to specific embodiments thereof which are illustrated in the appended drawings. It is appreciated that these drawings depict only typical embodiments of the invention and are therefore not to be considered limiting of its scope. The invention will be described and explained with additional specificity and detail through the use of the accompanying drawings in which.

DETAILED DESCRIPTION OF THE PREFERRED EMBODIMENTS

The present invention relates to exercise apparatuses. In more particular the present invention relates to a self-adjusting treadmill having a moveable console and a self-adjusting cushioning assembly. According to one aspect of the present invention, the moveable console and the self-adjusting cushioning assembly of the treadmill automatically adjust based on user parameters. The user parameters can be input by the user or automatically detected when the user is positioned on the tread base. For example, in one embodiment, when the user stands on the treadmill, the console detects the height of the user and is automatically raised or lowered to tailor the positioning of the console relative to the height of the user. In another embodiment, when the user stands on the treadmill, the self-adjusting cushioning assembly detects the weight of the user and automatically adjusts the amount of cushioning to accommodate the weight of the user.

Figure 1:
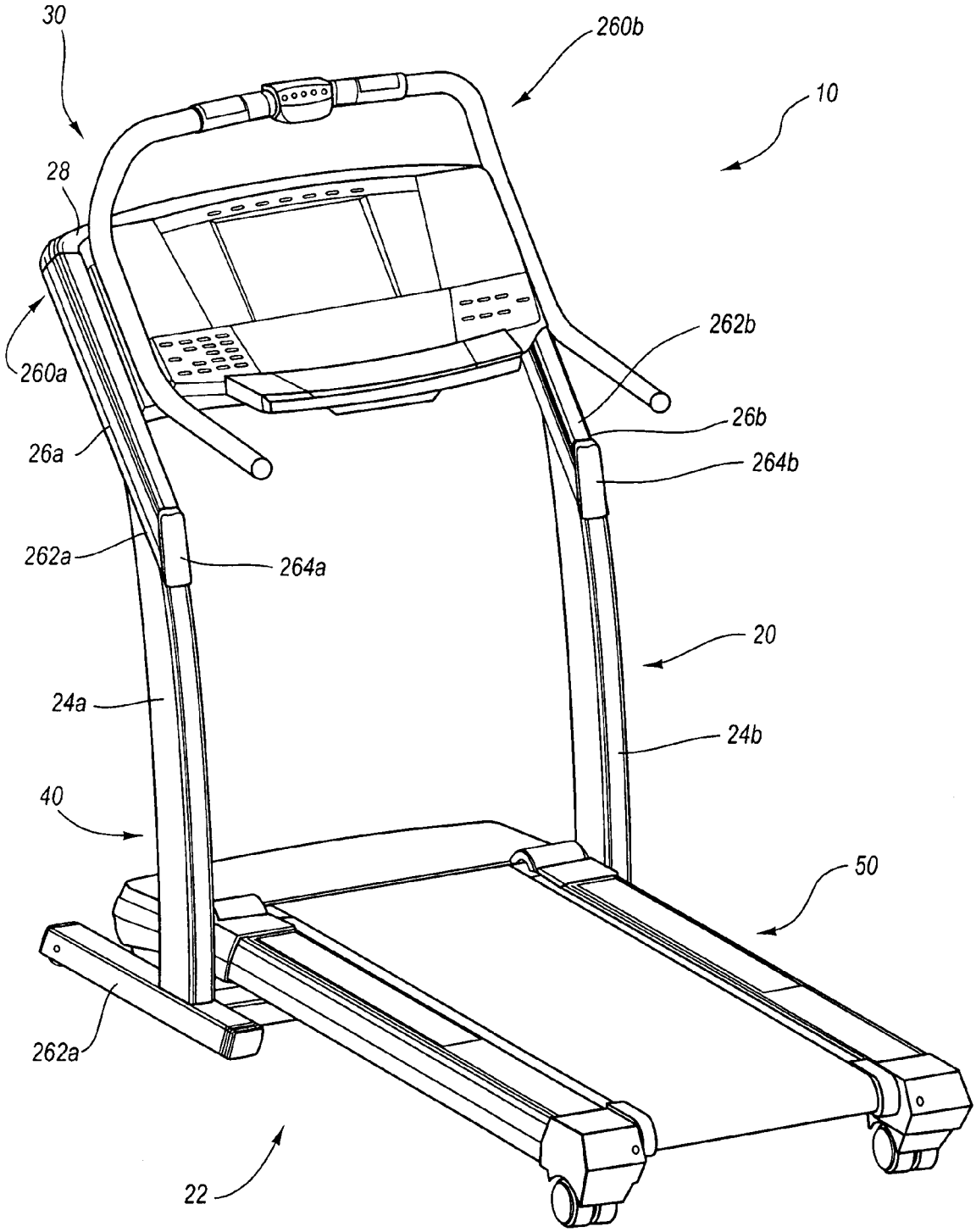
FIG. 1 is a perspective view of the self-adjusting treadmill illustrating the configuration of the console.

FIG. 1 illustrates a treadmill 10 utilized according to one embodiment of the present invention. In the illustrated embodiment, treadmill 10 is a self-adjusting treadmill having one or more features which detect user parameters and which automatically adjust one or more components of the treadmill based on the sensed user parameters. Examples of user parameters include, but are not limited to, the user's weight, height, body mass index, body fat percentage, height of one or more body features, heart rate, and the like. A variety of types of user parameters can be utilized in a variety of manners without departing from the scope and spirit of the present invention. For example, the height of the user can be utilized to set the height of a console of the treadmill. In another example, the weight of the user is utilized to set the amount of the cushioning of the treadmill.

In the illustrated embodiment, treadmill 10 comprises a frame 20, a console 30, a drive motor assembly 40, and a tread base 50. Frame 20 is coupled to other components of treadmill 10. Frame 20 provides stability to treadmill 10 when a user is exercising thereon. Additionally, frame 20 provides a mechanism to secure the components of treadmill 10 and to provide the desired configuration of treadmill 10. Console 30 is coupled to an upper portion of frame 20. Console 30 provides a user interface which allows a user to view information regarding an exercise routine being performed, select different exercise program variables, view parameters of the treadmill, and any of a variety of other features that can enhance the user's overall workout experience. Console 30 can include control circuitry to regulate operation of other components of the treadmill.

Drive motor assembly 40 is coupled to a bottom portion of frame 20. Drive motor assembly 40 is positioned toward the front of treadmill 10. Drive motor assembly 40 facilitates movement of an endless belt and inclining of tread base 50. Movement of the endless belt allows a user to run on the otherwise stationary tread base 50. As the user exercises on the endless belt, inclining of tread base 50 can simulate natural changes in the slope of the running surface that are encountered during a typical outdoor exercise routine. Tread base 50 provides a surface allowing a user to exercise on treadmill 10. Tread base 50 provides a desired amount of cushioning to the user exercising thereon. Tread base 50 is coupled to frame 20 and drive motor assembly 40.

Frame 20 provides stability and support to other components of treadmill 10. Frame 20 comprises a base 22, upright frame members 24*a, b*, and console support members 26*a, b*. Base 22 is positioned at the bottom of frame 20. Base 22 is configured to be in contact with the floor or other surface on which treadmill 10 is positioned. Upright frame members 24*a, b* are coupled to base 22 and console support members 26*a, b*. Upright frame members 24*a, b* support console support members 26*a, b* while providing a desired degree of displacement between base 22 and console support members 26*a, b*. In the illustrated embodiment, upright frame members 24*a, b* are fixedly connected to base 22 to provide a rigid and constant configuration of frame 20.

Console support members 26*a, b* are coupled to the upper ends of upright frame members 24*a, b*. Console support members 26*a, b* are also coupled to console 30. The coupling between console support members 26*a, b* and console 30 permits console 30 to move relative to console support members 26*a, b*. In the illustrated embodiment, console support members 26*a, b* are positioned at an angle relative to upright frame members 24*a, b*. The angle at which console support members 26*a, b* are positioned relative to upright frame members 24*a, b* allow the height of console 30 to be adjusted while also changing how close console 30 is positioned relative to the user.

A cross member 28 is connected to the upper ends of console support members 26*a, b*. Cross member 28 maintains a desired displacement between console support members 26*a, b* while also maintaining the overall configuration of frame 20. As will be appreciated by those skilled in the art, a variety of types and configurations of frames can be utilized in connection with the treadmill without departing from the scope and spirit of the present invention. For example, in one embodiment, console support members are immovably coupled relative to console. In the embodiment, the console support members are configured to move relative to other components of the frame to change the height of the console. In another embodiment, a single console support member is positioned such that the console can move relative to the single console support member. In another embodiment, the console moves relative to the frame without the use of console support members.

As previously discussed, console 30 is configured to be moveable relative to at least one other component of treadmill 10. In the illustrated embodiment, console 30 moves relative to both frame 20 and tread base 50. Console 30 is movably coupled to console support members 26*a, b* such that console 30 moves relative to console support members 26*a, b* when the height of console 30 is being adjusted. According to one embodiment of the present invention, the height of console 30 is automatically adjusted when the user stands on tread base 50. When a user stands on tread base 50, console 30 automatically detects the height of the user and adjusts the height of console 30 to tailor the height of console 30 to the user. A variety of types and configurations of movable consoles can be utilized without departing from the scope and spirit of the present invention. In one embodiment, the console changes position based on the speed that the endless belt is moving about the tread base. In another embodiment, the console changes position based on the proximity of the user to the console. In another embodiment, the console can move forward and backward in addition to up and down.

Figure 2A:
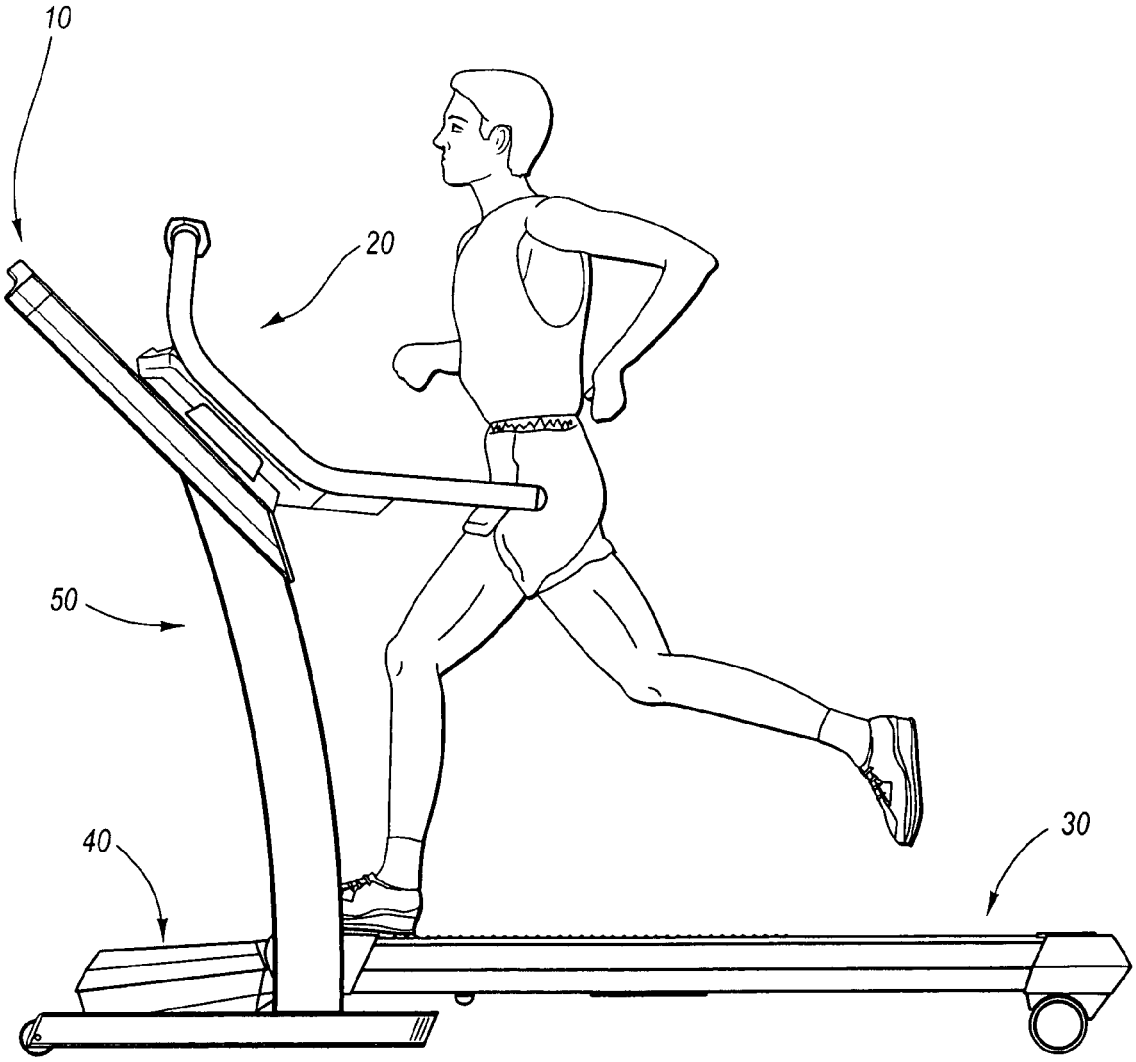
FIG. 2A is a side view of the self-adjusting treadmill with the console positioned at a lower height corresponding with the height of the user exercising on the self-adjusting treadmill.

FIG. 2A is a side perspective view of treadmill 10 illustrating a user exercising on treadmill 10. In the illustrated embodiment, the configuration of drive motor assembly 40 and tread base 50 relative to frame 20 is illustrated. Console 30 is coupled to console support members 26*a, b*. Console 30 is illustrated at a position near the lower end of console support members 26*a, b*. In this configuration, console 30 is positioned at or near its lowest height setting. A height sensor 36 of console 30 is positioned on the upper extremity of console 30. Height sensor 36 directs a signal, such as a light source, infrared source, laser or other means of detecting the height of the user, in the direction of the user. For example, where sensor 36 utilizes an infrared light, the infrared light emanates from height sensor 36 and then monitors for reflection of the infrared light off a surface such as the user's head or torso. Sensor 36 detects the height of the user by monitoring a transition from the presence of reflected light to the absence of reflected light or vice versa. Once the height of the user is detected movement of console 30 is stopped, thus setting the height of console 30 at a height tailored to the height of the user. In the illustrated embodiment, the user has a relatively short height and thus console 30 is positioned at or near its lowest position.

According to one embodiment of the present invention, the height of console 30 is adjusted from a default position at either its lowest or highest position. For example, where the default height of console 30 is at the highest position, the console 30 moves from its highest position downwards until the height of the user is sensed and the corresponding desired console height is achieved. Where the default height of the console is its highest position, the console does not move if reflected light is sensed. Movement of the console 30 only begins when height sensor 36 detects an absence of reflected infrared light. As the console 30 moves downwards relative to console support members 26*a, b* an infrared light beam emanates from height sensor 36 and the sensor monitors for reflection of the infrared light beam. As console 30 moves in the downward direction, the infrared light beam intersects the head of the user.

When the infrared light beam intersects the head of the user, the infrared light reflects from the head of the user and is detected by the infrared sensor of height sensor 36. Once the reflected light is detected, movement of the console 30 is stopped setting the height of console 30. This tailors the height of console 30 relative to the user allowing simple and advantageous manipulation of the controls on console 30. This also allows the user to view the screens and/or monitors utilized in connection with console 30 at an optimal height. Additionally, positioning of console 30 tailors the height of handrail assembly such that the handrail can be grasped easily and at a comfortable angle by the user.

Figure 2B:
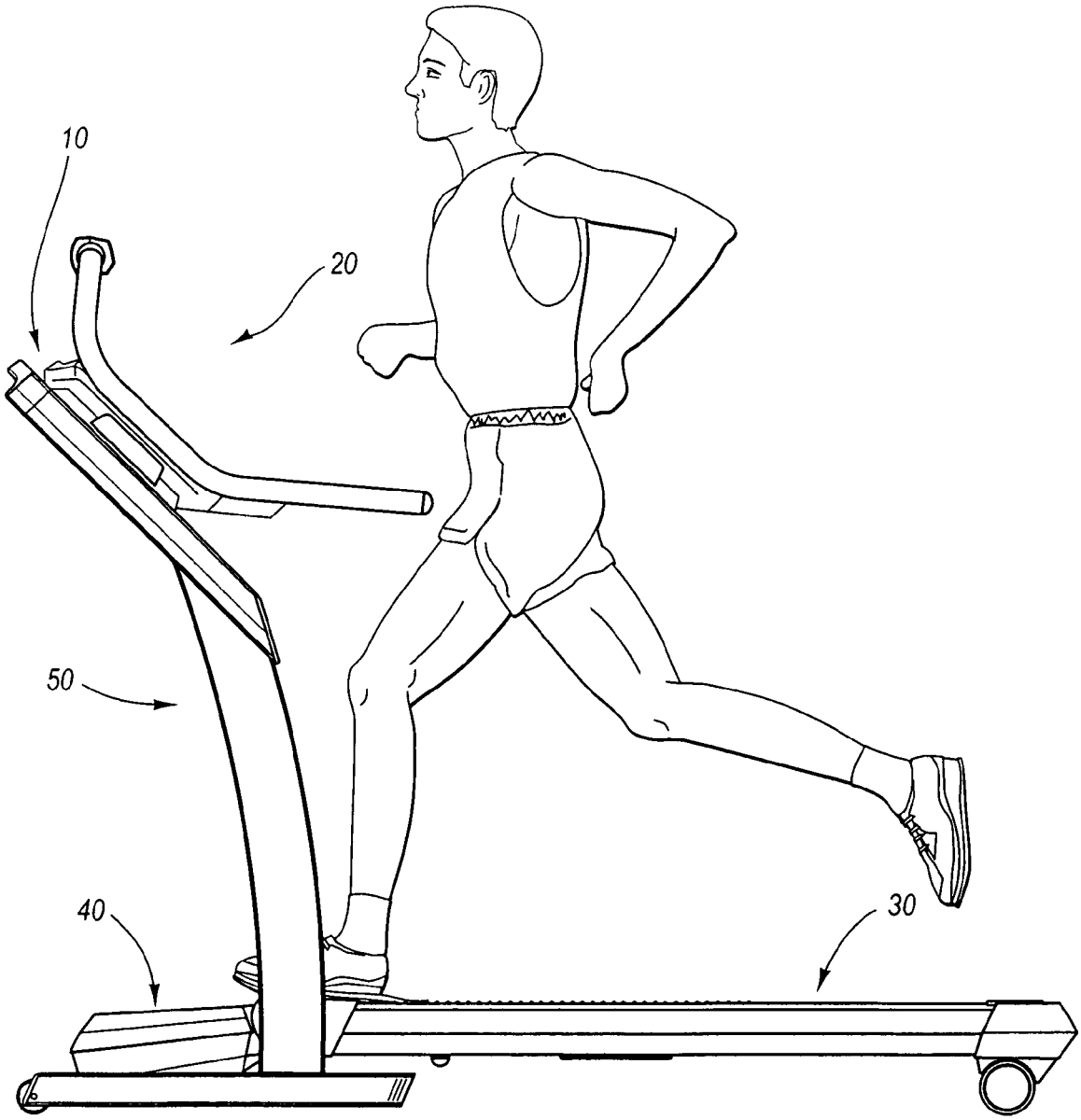
FIG. 2B is a side view of the self-adjusting treadmill illustrating the console at a higher position corresponding with the height of the user exercising on the self-adjusting treadmill.

FIG. 2B is a side perspective view of treadmill 10 illustrating operation of console 30. In the illustrated embodiment, a user is excising on treadmill 10. The user is positioned on tread base 50. In the illustrated embodiment, the user exercising on treadmill 10 is substantially taller than the user depicted in FIG. 2A. Height sensor 36 of console 30 detects the taller height of the user exercising on treadmill 10. Console 30 is adjusted to position console 30 at a height tailored to the height of the user. In the illustrated embodiment, console 30 is positioned at its highest elevation allowing the taller user to easily view the display of console 30, adjust user settings, and or grip handrails of console 30.

Figure 3:
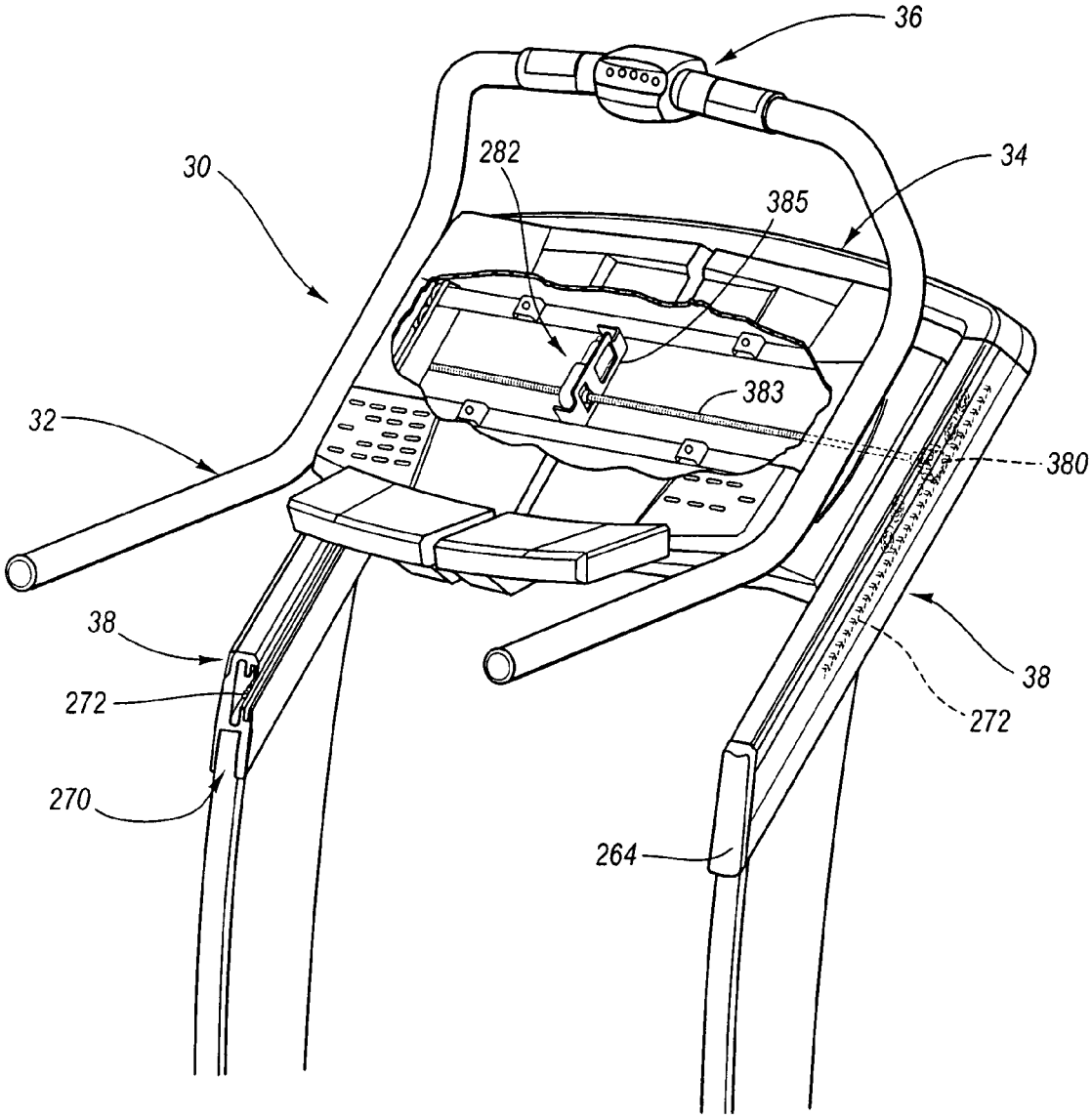
FIG. 3 is a perspective view of the console of the self-adjusting treadmill illustrating components of the console including the height sensor.

FIG. 3 is a cross-sectional view of console 30 illustrating components of console 30 including height adjustment motor 31. As previously discussed, console 30 is positioned between console support members 26*a, b* and below cross member 28. Console 30 provides a mechanism for communicating information to the user and receiving input from the user. In the illustrated embodiment, console 30 includes a handrail assembly 32, a user interface 34, a height sensor 36, and a console height adjustment mechanism 38.

Handrail assembly 32 of console 30 is positioned on lateral sides of console 30. Handrail assembly 32 provides a mechanism allowing a user to grasp console 30 to provide stability and support to the user. In the illustrated embodiment, movement of console 30 results in adjustment of the elevation of the handrail assembly 32. As a result, when console 30 adjusts to accommodate a user's height, the elevation of handrail assembly 32 is also adjusted to tailor the elevation of handrail assembly 32 to facilitate comfortable gripping by the user of the handrail assembly 32. As will be appreciated by those skilled in the art, a variety of types and configurations of handrail assemblies can be utilized without departing from the scope and spirit of the present invention. For example, in one embodiment the handrail assembly 32 is adjustable independently from the console. In another embodiment, the handrail assembly is directly connected to the frame of the treadmill. In another embodiment, a different mechanism for allowing a user to grip the treadmill and to provide stability and support to the user is provided.

User interface 34 is positioned on the front of console 30 to facilitate interactivity between treadmill 10 and the user. In the illustrated embodiment, the user interface includes a display and a plurality of buttons. The display provides a mechanism for communicating information, data, exercise program information, user physiological information, or any of a variety of other types and combinations of information to the user. The buttons allow the user to select different exercise program routines, different display screens, speeds of running, degrees of incline of the tread base 50, and a variety of other types and parameters of the treadmill to provide the desired interactivity and tailoring of the treadmill to the specifications desired by the user. As will be appreciated as those skilled in the art, a variety of types and configurations of user interfaces can be utilized in connection with console 30 without departing from the scope or spirit of the present invention. For example, in one embodiment, a plurality of user displays are positioned on console 30. In another embodiment, no interactive display is utilized.

Height sensor 36 is coupled to handrail assembly 32 at the top of console 30. Height sensor 36 senses the height of the user positioned on tread base 50. By allowing the height of the user to be established, the height of the console can be tailored to the height of the user. A variety of types and configurations of height sensors can be utilized without departing from the scope and spirit of the present invention. For example, in one embodiment, the height sensor can detect the height of the user independent of movement of console. In another embodiment the height sensor detects the height of the user as the console moves from top to bottom or bottom to top. In another embodiment, the height sensor is positioned on the frame of the treadmill. In another embodiment the height sensor is positioned at a location on the console other than the top of the handrail assembly.

Console height adjustment mechanism 38 moves the console to tailor the height of the console to the height of the user standing on the tread base 50. In the illustrated embodiment, console height adjustment mechanism 38 comprises a gear 380, a height adjustment motor 382, a drive shaft 383, and a bracket 385. Gear 380 engages console support members 26*a, b* to move console 30 relative to frame 20 and tread base 50. Height adjustment motor 382 provides the force to cause movement of gear 380 and the consequent raising and/or lowering of console 30. A variety of types and configurations of consoles can be utilized without departing from the scope and spirit of the present invention. For example, in one embodiment, the console can be manually adjusted. In another embodiment, the console comprises a motorized console assembly that is automatically adjustable. In another embodiment, the console can be adjusted based on personalized setting selected relative to, or by, a user.

Height adjustment motor 382 provides the force necessary to generate the rotational movement of drive shaft 383. Drive shaft 383 conveys the force provided by height adjustment motor 382 to gear 380. The lower end of console support member 26*a* is illustrated with endcap member 264*a* being removed. The grooves in console support member 26*a* are adapted to accommodate a portion of console height adjustment mechanism 38. As will be appreciated by those skilled in the art, a variety of types and configurations of height adjustment mechanisms can be utilized without departing from the scope and spirit of the present invention. An illustrative console height adjustment mechanism will be illustrated in greater detail with reference to FIG. 5.

Figure 4:
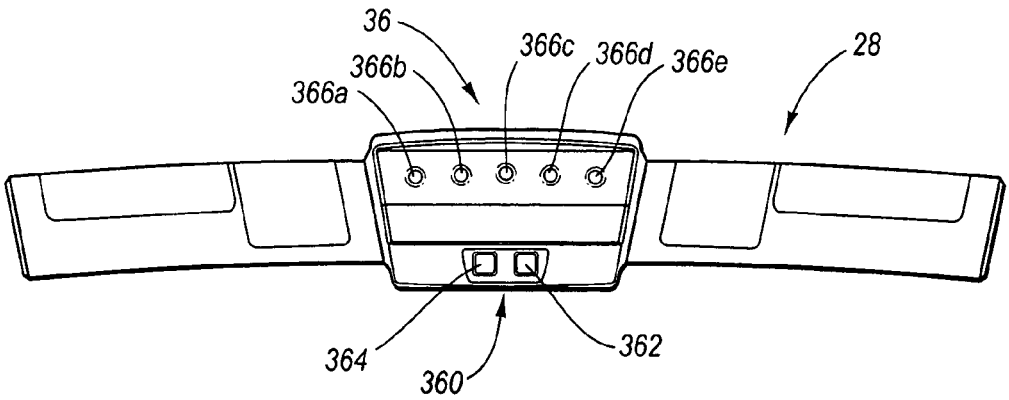
FIG. 4 is a front view of the height sensor of the console.

FIG. 4 illustrates a height sensor 36 according to one embodiment of the present invention. In the illustrated embodiment, height sensor 36 is coupled to a cross portion of handrail assembly 32. In the illustrated embodiment, height sensor 36 includes a handrail sensor mechanism 360 and status Light Emitting Diodes (leds) 366*a-e*. Sensor mechanism 360 detects the height of a user positioned on tread base 50 of treadmill 10. Sensor mechanism 360 includes a light source 362 and a light detector 364. Light source 362 provides the light that is utilized to detect the height of the user. Light emanating from light source 362 can reflect from the user when the light contacts the user. When light reflects from the user, it is detected by light detector 364. In this manner, sensor mechanism 360 can detect whether a user is positioned in front of height sensor 36.

In the illustrated embodiment, height sensor 36 utilizes movement of console 30 to detect the height of the user. For example, where the console starts at a default position at its upper-most height, light emanates from light source 362. Light detector 364 is actuated to determine whether light from light source 362 is reflecting from the user. If no reflected light is detected, console 30 moves downward in the direction of the lower end 262*a, b* of console support members 26*a, b*. As console 30 moves downward, light source 362 intersects the point at which the user's head is contacted by light emanating from light source 362. As the light emanating from light source 362 contacts the user's head it is reflected such that it can be detected by light detector 364. At this point, the height of the user is ascertained and the height of the console is set accordingly.

According to one embodiment of the present invention, once reflected light is detected at light detector 364, console 30 stops its downward progression. The angle of the light emanating from light source 362 is set such that the light will contact and reflect from the user when console 30 is at the desired height for the user. By stopping the downward movement of console 30 once reflected light is detected, the height of the console is set at a level tailored to the height of the user positioned on tread base 50. A variety of types and configurations of height sensors can be utilized without departing from the scope and spirit of the present invention. For example, in one embodiment light source 362 utilizes an infrared beam to detect the height of the user. In another embodiment, light emanating from the light source is directed at an upward angle such that the console is positioned at a desirable elevation relative to the overall height of the user. In another embodiment, a laser or other light source is utilized in connection with the sensor mechanism. In another embodiment, the console starts at a default position in which the console is at its lowest height and moves upward to detect the height of the user.

In the illustrated embodiment, status leds 366*a-e* are positioned on the upper portion of height sensor 36. Status leds 366*a-e* provide a visual indication of operability of height sensor 36. For example, status leds 366*a-e* can provide an indication by flashing alternatively, consecutively, iteratively or in any other type or combination to indicate operability of height sensor 36. For example, in one embodiment, when height sensor 36 is attempting to identify the height of the user, status leds 366*a-e* flash to indicate that a determination of the user's height is in progress. In another embodiment, once the determination of the user's height has been made, one or more of the status leds 366*a-e* are actuated as an indicator of the height detected and thus the height of console 30. A variety of types and other configurations of status leds can be utilized in a variety of manners without departing from the scope and spirit of the present invention.

Figure 5:
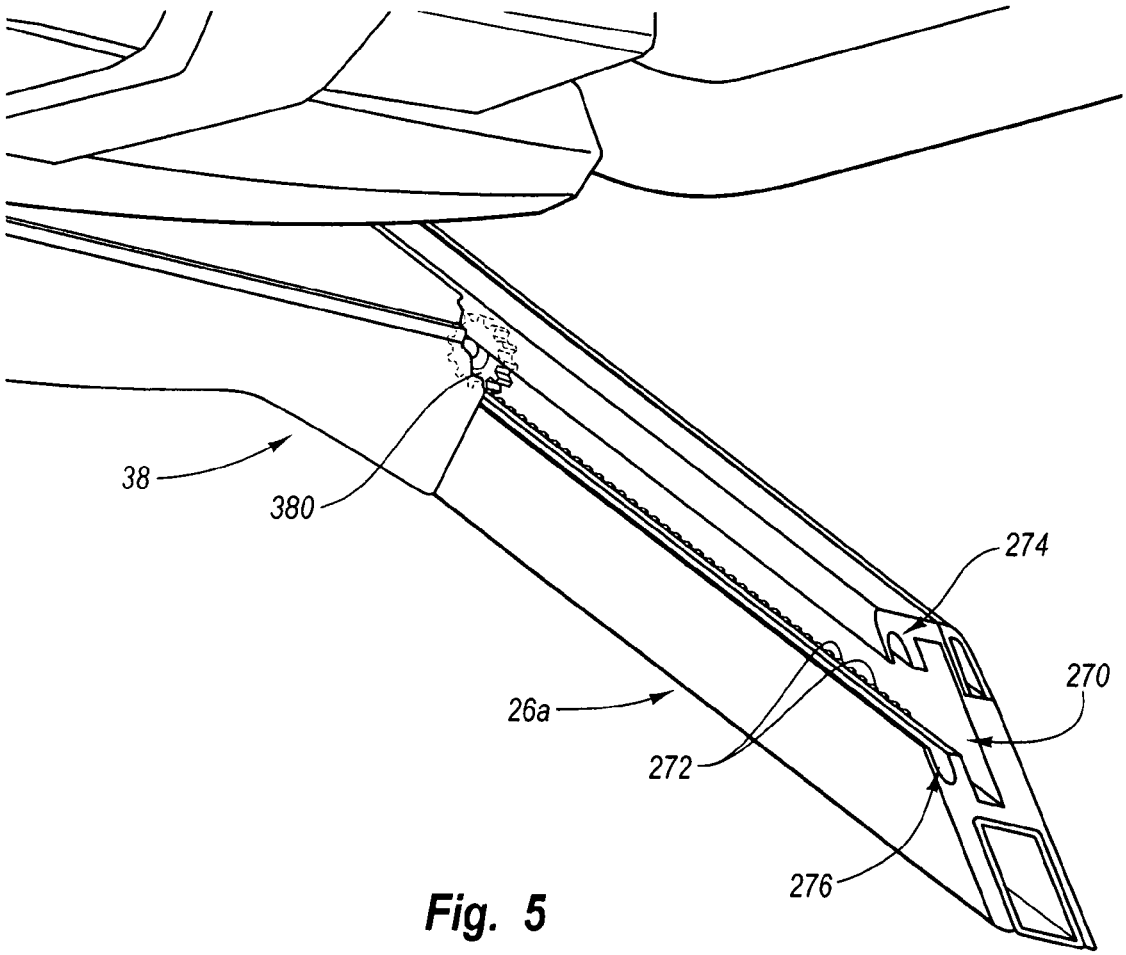
FIG. 5 is a cut-away view of the console height adjustment mechanism of the console.

FIG. 5 is a cut-away side view of console support member 26*a* illustrating console height adjustment mechanism 38 of console 30. In the illustrated embodiment, the lower end 262*a* of console support member 26*a* is illustrated. Lower end 262*a* of console support member 26*a* includes a gear slot 270, a rack 272, an upper guide portion 274, and a lower guide portion 276. The components of console support member 26*a* interact with console height adjustment mechanism 38 to allow for movement of console 30. Console height adjustment mechanism 38 includes a gear 380 and a height adjustment motor 382 (see FIG. 3). Gear 380 engages rack 272 of console support member 26*a*. As gear 380 is rotated by height adjustment motor 382 movement of gear 380 results in repositioning of console 380 as the teeth of gear 380 engage rack 272.

Gear 380 is positioned in gear slot 270. The size and width of gear slot 270 accommodates gear 380 to allow for movement of gear 380 along the length of rack 272. Upper guide portion 274 and lower guide portion 276 engage a flange of console 30. The flange, in combination with upper guide portions 274 and lower guide portion 276, ensures smooth and efficient movement of console 30 while preventing lateral movement along the length of console 30. As will be appreciated by those skilled in the art, a variety of types and configurations of console height adjustment mechanisms can be utilized without departing from the scope and spirit of the present invention. For example, in one embodiment the console height adjustment mechanism utilizes a lead screw to adjust to the height of the console. In another embodiment, the console is moved by moving the console support members.

Figure 6:
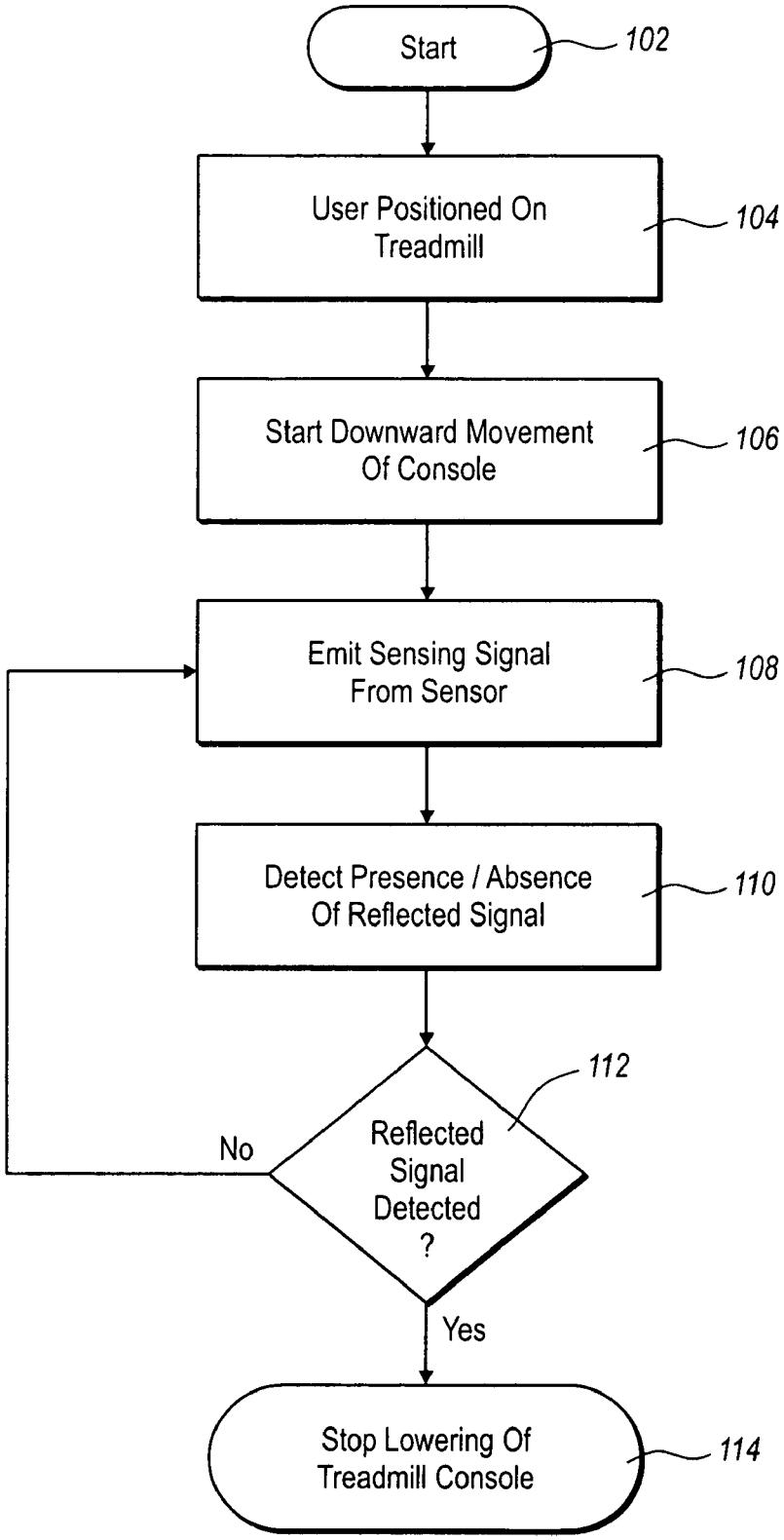
FIG. 6 is a flow diagram illustrating a method of utilizing a self-adjusting console.

FIG. 6 is a flow diagram illustrating a method for adjusting the height of a console based on the height of the user positioned on the treadmill. The method is started in step 102. It is than ascertained whether a user is positioned on the treadmill in step 104. Once it is determined that a user is positioned on the treadmill, downward movement of the console is started from a default position at the console's uppermost position in step 106. Once downward movement of the console is started, a sensing signal is emitted from the sensor in step 108. The sensing signal can comprise a infrared light source, a laser, or other signal utilized to detect the height of the user.

Once the signal is emitted from the sensor, the presence or absence of a reflected signal is detected in step 110. It is then determined if a reflective signal has been detected in step 112. If no reflected signal has been detected then the method returns to step 108 and a sensing signal is again emitted from the sensor. If a reflected signal has been detected then downward movement of the console is stopped in step 114. Once the lowering of the treadmill console has been stopped, the height of the user has been ascertained and the console has tailored to the height of the user and the method is ended in step 116.

As will be appreciated by those skilled in the art, a variety of types and configurations of methods can be utilized to automatically adjust the height of the treadmill without departing from the scope and spirit of the present invention. For example, in one embodiment, additional acts are utilized to readjust the treadmill every time the user changes the degree of inclination of the tread base. In another embodiment, detection of the height of the user does not start from a default position. In the embodiment, the console starts with upward movement where a reflected signal is detected or starts with downward movement where no reflected signal is detected. The height of the user is determined where the sensor detects a transition from a reflected signal to a non-reflected signal and vice versa.

Figure 7:
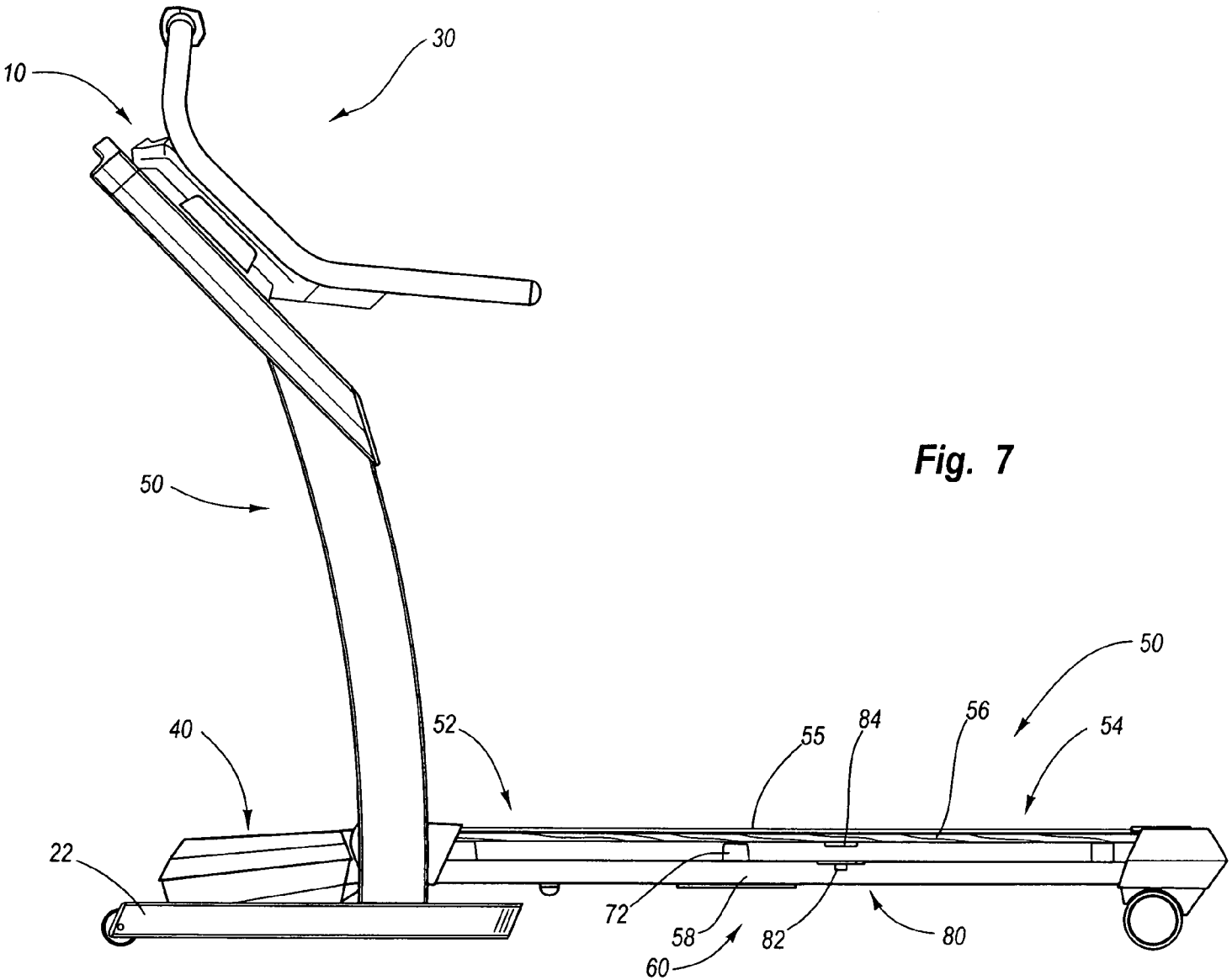
FIG. 7 is a side view of the self-adjusting treadmill illustrating the cushioning assembly according to one aspect of the present invention.

FIG. 7 is a side perspective view of treadmill 10 illustrating a cushioning assembly 60 according to one aspect of the present invention. Cushioning assembly 60 is utilized in connection with tread base 50. Tread base 50 provides a surface allowing a user to exercise on treadmill 10. Tread base 50 is coupled to frame 20 and drive motor assembly 40. Tread base 50 includes a proximal end 52, a distal end 54, an endless belt 55, a deck 56, and a tread base frame 58. Proximal end 52 of tread base 50 is positioned adjacent to drive motor assembly 40. Distal end 54 is positioned away from drive motor assembly 40. Endless belt 55 is trained around deck 56. Endless belt 55 provides a continuous running surface simulating movement of a road base or other ambulatory surface on which a user ambulates during exercise on treadmill 10. Deck 56 provides support below endless belt 55 to withstand impact from a user exercising thereon. According to one embodiment of the present invention, deck 56 flexes during impact to provide cushioning to a user exercising on tread base 50. Tread base frame 58 provides a support structure upon which other components of tread base 50 are coupled.

Cushioning assembly 60 is coupled to tread base 50. Cushioning assembly 60 provides cushioning to control the amount of deflection of deck 56 with respect to tread base frame 58. According to one embodiment of the present invention, cushioning assembly 60 automatically adjusts the amount of cushioning experienced by the user on deck 56. The amount of cushioning provided can be varied based on the weight, desired amount of deflection of the deck, or other parameters that can be utilized to customize the amount of cushioning provided by cushioning assembly to a user exercising on tread base 50.

In the illustrated embodiment, cushioning assembly 60 comprises a variable cushioning mechanism 70 and a deflection sensor assembly 80. Variable cushioning mechanism 70 provides a mechanism for providing variable amounts of cushioning to a user exercising on tread base 50. Deflection sensor assembly 80 provides a mechanism for monitoring user parameters, such as the weight of the user or body mass index of the user, to automatically adjust the amount of cushioning provided by cushioning assembly 60.

In the illustrated embodiment, variable cushioning mechanism 70 includes a cushioning member 72. Cushioning member 72 is coupled to a portion of tread base frame 58. Cushioning member 72 is comprised of a resilient material that is utilized to absorb impact on deck 56. Cushioning member 72 contacts deck 56 such that when a user is exercising on deck 56 cushioning member 72 absorbs impact while also controlling the amount of deflection of deck 56. Variable cushioning mechanism 70 is one example of an adjustment mechanism. Variable cushioning mechanism 70 will be discussed in greater detail with reference to FIG. 8.

A variety of types and configurations of adjustment mechanisms can be utilized without departing from the scope and spirit of the present invention. For example, in one embodiment, the adjustment mechanism is selected from one of the group consisting of a rheologic mechanism, an airbag, a spring, an air shock, a hydraulic cylinder, a hydraulic bellow, a leaf spring, a coil spring, a solid hollow elastomeric member, a bellows, a cylinder, and a gas shock.

In the illustrated embodiment, deflection sensor assembly 80 includes a sensor mechanism 82 and a deflection member 84. Deflection member 84 is coupled to deck 56 such that deflection of deck 56 result in movement of deflection member 84. Sensor mechanism 82 is coupled to tread base frame 58. Sensor mechanism 82 detects movement of deflection member 84 and monitors the amount of movement of deflection member 84. Based on the amount of movement of deflection member 84 sensor mechanism is able to ascertain the amount of deflection of deck 56. The deflection of the deck can be utilized in a variety of manners without departing from the scope and spirit of the present invention. For example, in one embodiment the amount of deflection of the deck can be utilized to determine if the user can safely use the treadmill. In one embodiment, a small amount of deflection can allow the system to determine if a child is positioned on the treadmill. Based on the determination, the system can prevent movement of the endless belt.

A variety of types and methods for controlling cushioning of the treadmill can be utilized without departing from the scope and spirit of the present invention. In one embodiment, utilizing known qualities of deck, the amount of deflection of deck can be used to ascertain the weight of the user standing on deck. In another embodiment, the amount of deflection of deck is used to maintain desired amounts of cushioning for users of different weights. In yet another embodiment, the amount of cushioning is set at a pre-adjustment setting when the user first steps on the tread base and is then adjusted as the user begins to exercise.

Utilizing the pre-adjustment setting allows the system to approximate the cushioning setting that will provide the desired amount of cushioning during exercise. For example, the amount of cushioning can be controlled to maintain a desired amount of deflection of the deck. For the sake of illustration, and without restriction the following numerical description provides an example of how a pre-adjustment setting can be utilized. In the example, the amount of cushioning is adjusted to maintain the displacement of the deck between 0.5 inches and 0.75 inches. When a heavy user steps on the deck resulting in displacement of more than 0.75 inches, the amount of cushioning is decreased until the displacement is less than 0.75 inches. When a light user steps on the deck resulting in displacement of less than 0.5 inches, the amount of cushioning is increased until the displacement is greater than 0.5 inches. As the user begins to exercise deflection of the deck increases due to the greater force exerted during running or walking than when just standing on the deck. During exercise, the amount of cushioning is adjusted if the displacement of the treadmill is not between the target displacement of 0.75 inches and 1.0 inches. By utilizing the pre-adjustment setting between 0.5 inches and 0.75 inches, the amount of displacement experienced when exercise is started will be approximately between the target of 0.75 inches and 1.0 inches.

Deflection sensor assembly can be utilized in a variety of manners to sense parameters regarding the user. For example, the body mass index of the user can be determined using the height and automatically sensed weight of the user. In another embodiment, indicia are utilized to illustrate a point on tread base on which the user is to stand to accurately sense the height and weight of the user. Deflection sensor assembly will be discussed in greater detail with reference to FIG. 8. As will be appreciated by those skilled in the art, the cushioning assembly of the present invention can be utilized with a variety of types and configurations of treadmills. For example, the cushioning assembly can be utilized with a treadmill in which the deck does not flex to absorb impact of the user exercising thereon.

Figure 8:
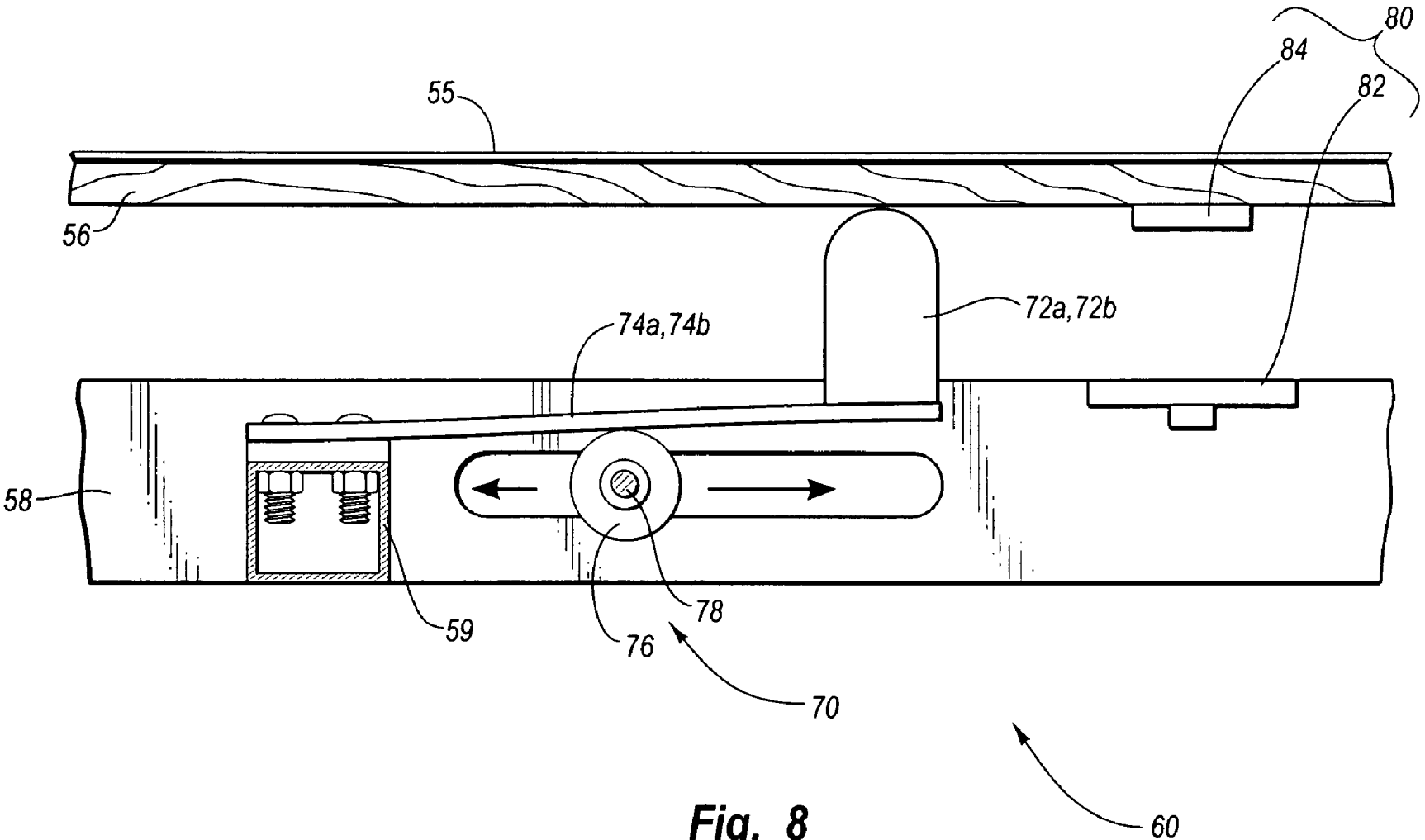
FIG. 8 is an internal view of the tread base illustrating the cushioning assembly utilized in connection with the self-adjusting treadmill.

FIG. 8 is a close up side view of cushioning assembly 60 illustrating variable cushioning mechanism 70 and deflection sensor assembly 80. In the illustrated embodiment, variable cushioning mechanism 70 is coupled to tread base frame 58 such that cushioning member 72 contacts deck 56. Variable cushioning mechanism 70 includes cushioning member 72, lever arm 74, and moveable fulcrum 76. As previously discussed, cushioning member 72 is adapted to contact deck 56 so as to absorb impact from a user exercising on tread base 50. Cushioning member 72 is coupled to lever arm 74. Lever arm 74 provides a variable amount of resistance based on the effective length of the lever as determined by the position of movable fulcrum 76 along the length of lever arm 74. Lever arm 74 is coupled to a cross member of tread base frame 58. Moveable fulcrum 76 is positioned beneath lever arm 74 between cushioning member 72 and the point of coupling with cross member 59.

When deck 56 deflects, force is exerted on cushioning member 72. In one embodiment, cushioning member 72 absorbs energy from the deflection of deck 56. Lever arm 74 can flex and thus absorb some of the energy from the deflection of deck 56. Moveable fulcrum 76 can be moved closer to, and away from, cushioning member 72. The effective length of lever arm 74 and the amount of flexing of lever arm 74 varies based on the position of moveable fulcrum 76. When moveable fulcrum 76 is positioned close to, or directly below, cushioning member 72 lever arm 74 flexes less than when movable fulcrum is positioned nearer to point of coupling 59. The smaller amount of flex of lever arm 74 results in a smaller amount of deflection of deck 56. As a result, the user experiences less cushioning and a stiffer deck during exercise on tread base 50. When moveable fulcrum is positioned further from cushioning member 72, greater leverage can be exerted on lever arm 74 resulting in a greater displacement of deck 56 and flexing of lever arm 74. As a result the user experiences more cushioning and a softer deck when a user is exercising on tread base.

Deflection sensor assembly 80 allows cushioning assembly 60 to automatically adjust the position of moveable fulcrum 76 to provide a desired amount of cushioning from variable cushioning mechanism 70. Because deflection of the deck is based in part on the weight of the person exercising on deck 56 moveable fulcrum 76 can be repositioned to maintain a desired amount of cushioning when a user of a different weight begins to exercise on deck 56. For example, if an intermediate amount of cushioning is selected, moveable fulcrum 76 will be moved toward cushioning member 72 when a relatively light weight user is replaced by a heavier user.

In the illustrated embodiment, deflection sensor assembly 80 is configured to sense differences in the weight of a new user positioned on deck 56 to automatically make adjustments to variable cushioning mechanism 70 to maintain a desired level of cushioning. As previously discussed, deflection member 84 is coupled to deck 56 of tread base 50. When a user is positioned on tread base 50, deck 56 deflects in a downward direction. Such deflection is sensed by sensor mechanism 82. The amount of movement of deflection member 84 is monitored and the weight of the user positioned on tread base 50 is ascertained. Based on the known weight of the user, moveable fulcrum 76 can be repositioned to maintain the desired degree of cushioning provided by variable cushioning mechanism 70.

In one embodiment, the variable cushioning mechanism 70 is given a pre-adjustment setting based on a coarse weight reading of the user when the user first is positioned on the deck. Once the user begins to exercise, the variable cushioning mechanism 70 undergoes additional adjustment to fine tune the amount of cushioning subsequent to the coarse weight reading. By providing a pre-adjustment setting based on a coarse weight reading, the variable cushioning mechanism 70 can more closely approximate the desired amount of cushioning before the user starts exercising. Thus, even before the exact weight or desired setting of the variable cushioning mechanism is ascertained, a rough estimation of the setting of the variable cushioning mechanism is provided. In one embodiment, a variety of coarse weight categories are determined with a pre-adjustment setting for the variable cushioning mechanism being associated with each coarse weight category. When the user steps on the deck 56, the coarse weight reading of the user is ascertained, associated with a weight category, and then the variable cushioning mechanism is automatically adjusted to the pre-adjustment setting associated with coarse weight category.

A variety of types and configuration of sensors can be utilized in a variety of manners without departing from the scope and spirit of the present invention. For example, in one embodiment the deflection sensor assembly comprises a hall effect sensor. In another embodiment, the deflection sensor is from a group comprising an optical sensor, a magnetic sensor, a potentiometer, a linear potentiometer, or a rotary potentiometer, a contact sensor, a contact sensing device. In another embodiment, the sensor detects the weight of the user without sensing deflection of the deck.

It will also be appreciated, that deflection sensor assembly 80 and variable cushioning mechanisms 70 can be utilized to provide additional functionality other than maintaining a desired degree of cushioning relative to users of different weights" For example, a user of a constant weight may desire a change in the amount of cushioning provided by variable cushioning mechanism 70 based on the type or intensity of exercise to be performed. For example, a user may select a large amount of cushioning for a long and slow paced workout while desiring a small amount of cushioning for a shorter more intense workout. By selecting a change in the amount of cushioning desired, moveable fulcrum 76 can be repositioned along the length of lever arm 74 to accommodate such changes in the desired amount of cushioning. Additionally, it will be appreciated that the location of the user on tread base 50 is not the only factor affecting the deflection of deck 56. For example, deflection of deck 56 can be a function of the amount of force exerted by the user on deck 56 during an exercise routine. A user having a constant weight will exert a given amount of pressure on deck 56 when walking and relatively greater amount of pressure on deck 56, resulting in a larger deflection of deck 56, when running at full speed. Such changes in deflection can be monitored by deflection sensor assembly 80. In response to changes in deflection, moveable fulcrum 76 can be moved along the length of lever arm 74 to maintain a desired degree of cushioning during an exercise routine in which the force exerted by the user on deck 56 changes during the routine.

Figure 9:
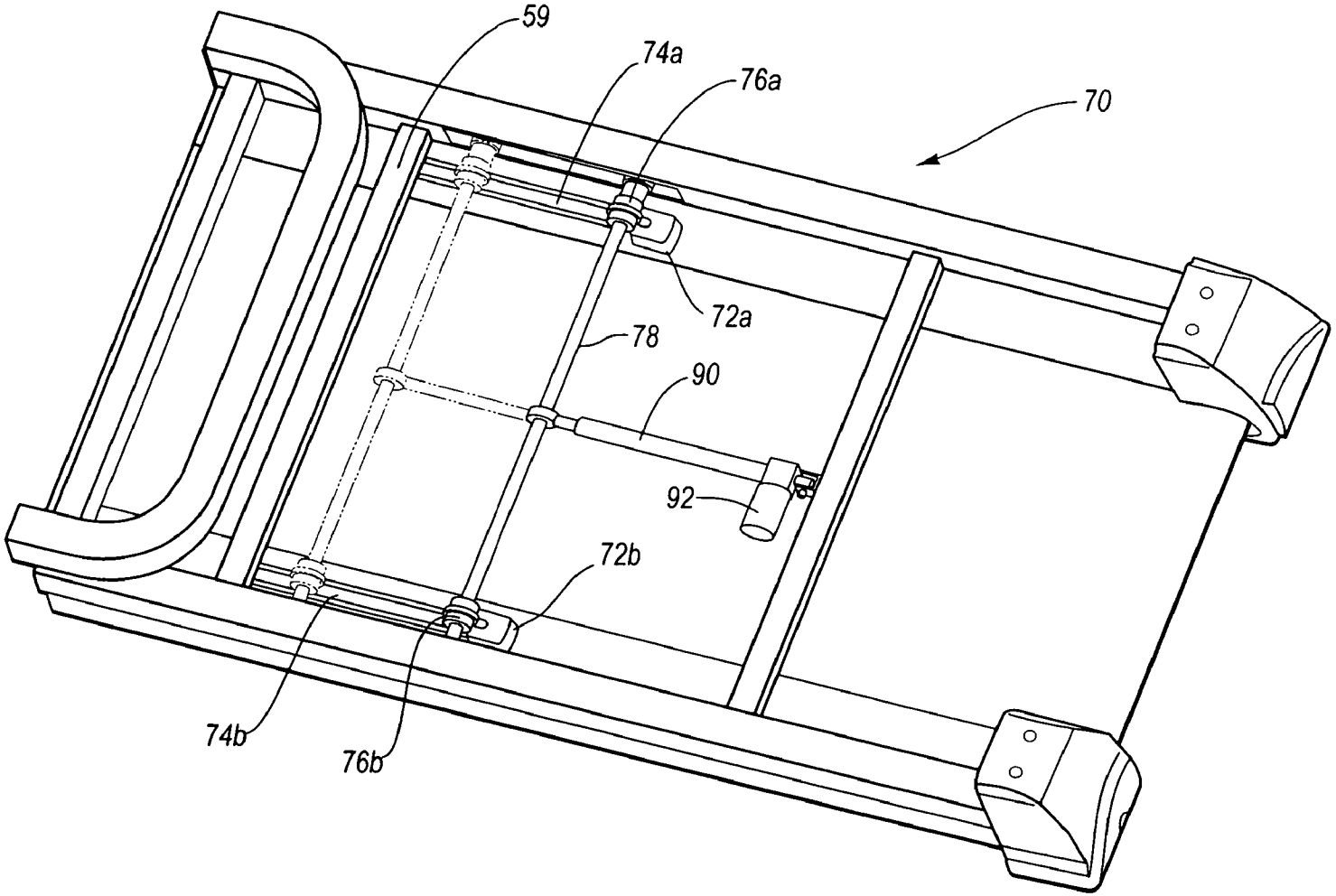
FIG. 9 is a bottom view of the self-adjusting treadmill illustrating the adjustment rod and cushioning adjustment motor utilized to control adjustment of the cushioning assembly of the self-adjusting treadmill.

FIG. 9 illustrates a bottom perspective view of treadmill 10 illustrating components of cushioning assembly 60 according to one aspect of the present invention. In the illustrated embodiment, variable cushioning mechanism 70 includes cushioning members 72*a, b*, lever arms 74*a, b*, moveable fulcrums 76*a, b* and a transverse bar 78. Cushioning members 76*a, b* are positioned on each side of deck 56 to provide a bilateral and predetermined amount of cushioning on deck 56. Additionally, lever arms 74*a, b* and moveable fulcrums 76*a, b* are positioned on either side of deck 56 to provide the desired level of cushioning on deck 56.

Transverse bar 78 is positioned between moveable fulcrum 76*a, b*. Transverse bar 78 facilitates uniform movement of moveable fulcrum 76*a, b* to maintain an equal amount of displacement of moveable fulcrums 76*a, b*. By maintaining an equal amount of displacement of movable fulcrums 76*a, b*, a consistent amount of cushioning is provided by lever arms 74*a, b* and cushioning members 72*a, b*. Transverse bar 78 is coupled to adjustment rod 90. Adjustment rod 90 is coupled to cushioning adjustment motor 92.

Cushioning adjustment motor 92 causes lengthening and shortening of adjustment rod 90. As adjustment rod 90 lengthens and shortens, movement of transverse bar 78 occurs proximally and distally along the length of moveable fulcrum 76*a, b*. Movement of transverse bar 78 results in movement of moveable fulcrum 76*a, b* and a change in the amount of cushioning provided by variable cushioning mechanism 70. As will be appreciated by those skilled in the art, a variety of types and configurations of cushioning assembly 60 can be used without departing from the scope and spirit of the present invention. For example, in one embodiment a lead screw assembly is utilized to cause movement of the moveable fulcrum. In another embodiment, a single cushioning member is positioned across the entire lateral length of the deck. In another embodiment, a plurality of variable cushioning mechanisms are positioned along the length of tread base. In another embodiment, a cushioning assembly is adapted to provide a variable amount of cushioning with a treadmill in which the cushioning is provided by mechanisms other than the treadmill deck.

Figure 10:
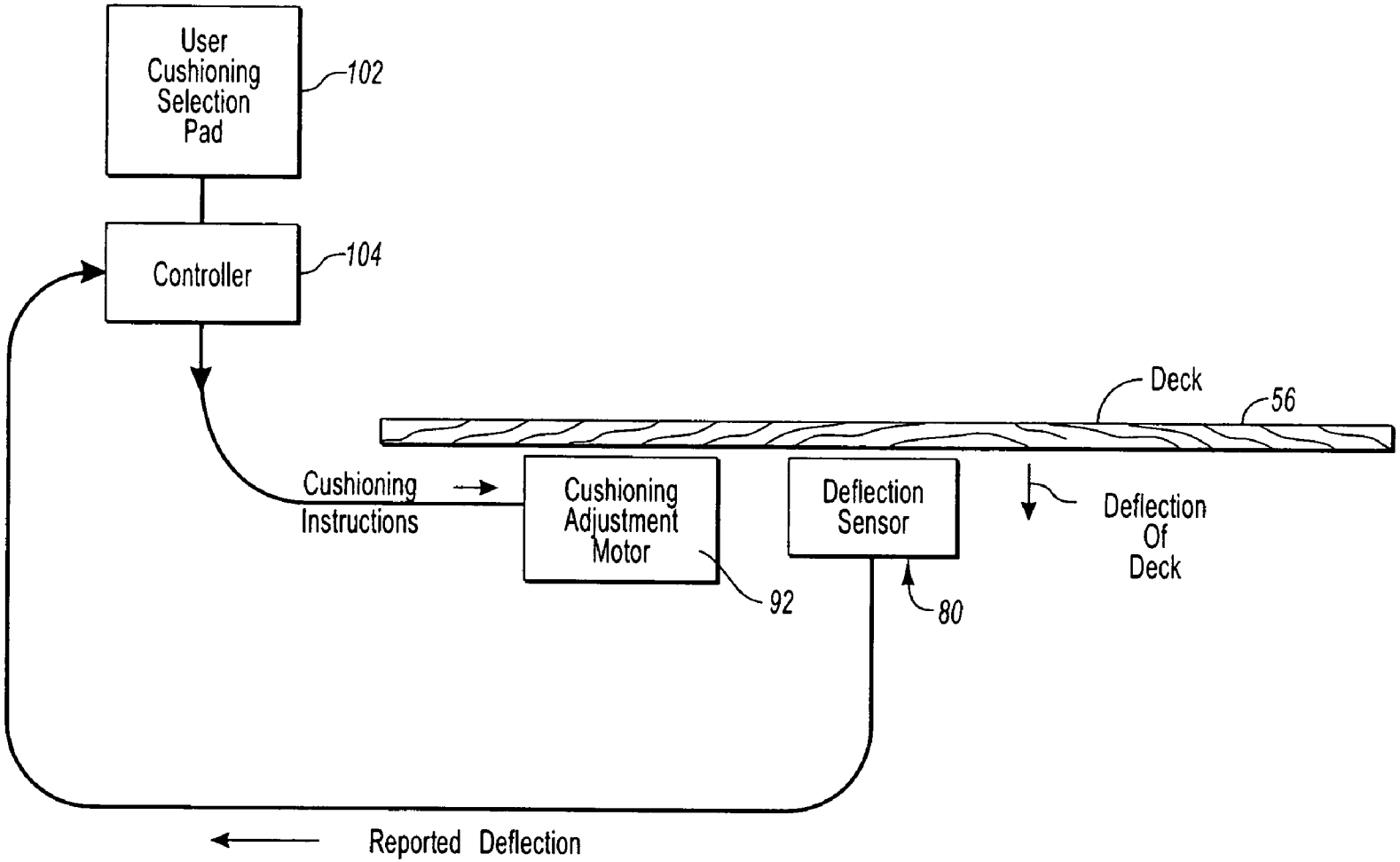
FIG. 10 is a functional block diagram illustrating a system for controlling adjustment of the cushioning assembly in connection with the self-adjusting treadmill.

FIG. 10 is a block diagram view illustrating operation of cushioning assembly 60 according to one aspect of the present invention. In the illustrated embodiment, when the weight of the user is placed on deck 56, deflection sensor assembly 80 detects deflection of deck 56 and conveys the amount of deflection to controller 101. Controller 101 ascertains the weight of the user based on the reported deflection and known properties of deck 56. The user inputs the desired amount of cushioning to be provided by the variable cushioning mechanism 70 by inputting the desired amount of cushioning into user cushioning selection pad 100. According to one embodiment of the present invention, user cushioning selection pad 100 is provided in the user interface of console 30.

Based on the weight of the user and information regarding the desired amount of cushioning input into user cushioning selection pad 100, controller 101 sends cushioning instructions to cushioning adjustment motor 92 of variable cushioning mechanism 70. The cushioning adjustment motor 92 causes movement of moveable fulcrum 76*a, b* to change the amount of cushioning to the desired amount of cushioning. In this manner, cushioning assembly 60 automatically detects the weight of the user and adjusts the amount of cushioning provided by variable cushioning mechanism 70 such that the amount of cushioning provided is appropriate based on the desired amount of cushioning selected by the user.

As will be appreciated by those skilled in the art, a variety of types and configurations of controllers can be utilized without departing from the scope and spirit of the present invention. For example, in one embodiment the controller comprises an input mechanism that allows the user to input a desired amount of cushioning. In one embodiment, the desired amount of cushioning is selected from a group consisting of hard, medium or soft cushioning. In another embodiment, the desired amount of cushioning can be selected from a continuum of amounts of cushioning.

According to one embodiment of the present invention, any changes in deflection of deck 56 are sensed by deflection sensor 80, and conveyed back to controller 101. Such changes in deflection of deck 56 can be caused by an increased impact force related to the intensity of the user's workout; changes in the weight of the user subsequent to a change in user; or other factors such as the use of weights added during the exercise routine. Additionally, any changes in the desired amount of cushioning to be provided by variable cushioning mechanism 70 can be monitored by controller 101. As a result, any combination of changes in reported deflection and desired amount of cushioning input by user can result in new cushioning instructions to variable cushioning mechanism 70. Such instructions can result in change of the position of moveable fulcrums 76*a, b* to change the amount of cushioning provided by lever arm 74 and cushioning member 72.

As will be appreciated by those skilled in the art, a variety of types and combinations of cushioning assemblies can be utilized without departing from the scope and spirit of the present invention. For example, the controller can be automatically set to change the amount of cushioning based on the amount of deflection of deck. In another embodiment, the deflection sensor and controller can be integrally coupled into a single unit. In another embodiment, the deflection sensor is actuated only in response to user input on the user cushioning selection pad. Any variety of combinations of cushioning assemblies and moveable consoles can be utilized without departing from the scope and spirit of the present invention. The disclosure of patent application entitled, "Cushioning Treadmill", filed Jan. 9, 2004 of Express Mail Number EV 396 740 446 US, is hereby incorporated by reference in its entirety.

The present invention may be embodied in other specific forms without departing from its spirit or essential characteristics. The described embodiments are to be considered in all respects only as illustrative and not restrictive. The scope of the invention is, therefore, indicated by the appended claims rather than by the foregoing description. All changes which come within the meaning and range of equivalency of the claims are to be embraced within their scope.

What is claimed is:

1. A treadmill, comprising:

a frame;

a treadbase coupled to the frame enabling a user to exercise thereon;

a console movably linked to the frame, wherein the height of the console can automatically adjust relative to the treadbase based on an initial position of a user feature relative to the console after the user steps onto the treadbase; and an adjustment mechanism linking the console to the frame, wherein the adjustment mechanism changes the height of the console based on the initial position of the user feature.

2. The treadmill of claim 1, wherein the height of the console can be adjusted manually.

3. The treadmill of claim 1, wherein the console is configured to change its height based on the height of the user standing on the treadbase.

4. The treadmill of claim 1, wherein the console is configured to change its height based on the height of a particular user feature.

5. The treadmill of claim 1, wherein the console is configured to change its height automatically.

6. The treadmill of claim 5, wherein the console is configured to change its height automatically when user steps on treadbase.

7. The treadmill of claim 5, wherein the console is configured to change its height automatically when the slope of the treadbase is adjusted.

8. The treadmill of claim 1, further comprising a plurality of indicia to indicate the height of the console.

9. The treadmill of claim 7, wherein the indicia include a plurality of lights.

10. A treadmill, comprising:

a frame having an upright member;

a treadbase coupled to the frame enabling a user to exercise thereon;

a console movably linked to the upright member of the frame, wherein the height of the console is automatically adjusted relative to the treadbase based on a height of a particular user feature; and an adjustment mechanism linking the console to the frame, wherein the adjustment mechanism adjusts the height of the console based on the height of the particular user feature.

11. The treadmill of claim 10, further comprising console support members.

12. The treadmill of claim 11, wherein the console is coupled to the console support members.

13. The treadmill of claim 12, wherein the console interacts with the console support members to change its height.

14. The treadmill of claim 13, wherein the console support members include a rack.

15. The treadmill of claim 14, wherein the console includes at least one gear.

16. The treadmill of claim 15, wherein the console includes a plurality of gears.

17. The treadmill of claim 16, wherein the plurality of gears of the console engages the rack of the console support members such that movement of the gear changes the height of the console.

18. The treadmill of claim 10, wherein the console support members each include a slot.

19. The treadmill of claim 18, wherein the console includes flanges that are positioned in the slots of the console support members such that uniform and consistent movement of console is achieved.

20. A treadmill, comprising:

a frame having an upright member and one or more console support members;

a treadbase coupled to the frame enabling a user to exercise thereon; and a console movably coupled to the one or more console support members, wherein the height of the console automatically adjusts from a first operational position to a second operational position based on the height of a user, wherein the console includes a height adjustment mechanism configured to move the console to adjust the height of the console from the first operational position to the second operational position.

21. The treadmill of claim 20, further comprising a height sensor, wherein the height sensor detects the height of a user standing on the treadbase.

22. The treadmill of claim 21, wherein the height sensor includes a light source.

23. The treadmill of claim 22, wherein the light source emits light to detect height of the user standing on the treadbase.

24. The treadmill of claim 23, wherein the light source detects the height of the user by reflecting light from the user.

25. The treadmill of claim 22, further comprising a light sensor.

26. The treadmill of claim 25, wherein the light sensor senses user height by detecting the transition from reflected light to non reflected light.

27. The treadmill of claim 26, wherein the height sensor starts at a default position to detect the height of the user.

28. The treadmill of claim 27, wherein the default position of the height sensor is the upper most height of the sensor and the sensor moves in the downwards direction until the height of the user is detected.

29. The treadmill of claim 27, wherein the default position of the treadmill is its lowest height and the sensor moves in an upward direction until the height of the user is detected.

30. The treadmill of claim 26, wherein the height sensor starts at a current height position to detect the height of the user.

31. The treadmill of claim 30, wherein the height sensor moves in an upward direction if the height sensor detects reflected light at its starting position and moves in a downward direction if the height sensor does not detect reflected light at its starting position.

32. The treadmill of claim 25, wherein movement of the height sensor is simultaneous with movement of the console.

33. The treadmill of claim 25, wherein movement of the console is needed to sense the height of the user.

34. The treadmill of claim 33, wherein the angle at which the height sensor is positioned is configured such that when the user height is detected the height of the console is set by stopping movement of the console.

35. A treadmill, comprising:

a frame;

a treadbase coupled to the frame enabling a user to exercise thereon; and a motorized console assembly movably linked to the frame and including a console, wherein the height of the console automatically adjusts relative to the treadbase based on a height of a particular user feature, wherein the motorized console assembly further includes an adjustment mechanism configured to adjust the height of the console during the automatic adjustment.

36. The treadmill of claim 35, wherein the motorized console assembly is configured to read the height of the user.

37. The treadmill of claim 35, wherein an initial height of the console is determined utilizing preset adjustments.

* * * * *

UNITED STATES PATENT AND TRADEMARK OFFICE

CERTIFICATE OF CORRECTION

PATENT NO. : 7,344,481 B2
APPLICATION NO. : 10/754166
DATED : March 18, 2008
INVENTOR(S) : Watterson et al.

It is certified that error appears in the above-identified patent and that said Letters Patent is hereby corrected as shown below:

Replace Figure 2A with the figure depicted herein below, wherein "50" has been changed to --20--, "20" has been changed to --30--, "30" has been changed to --50--, and "36" has been added.

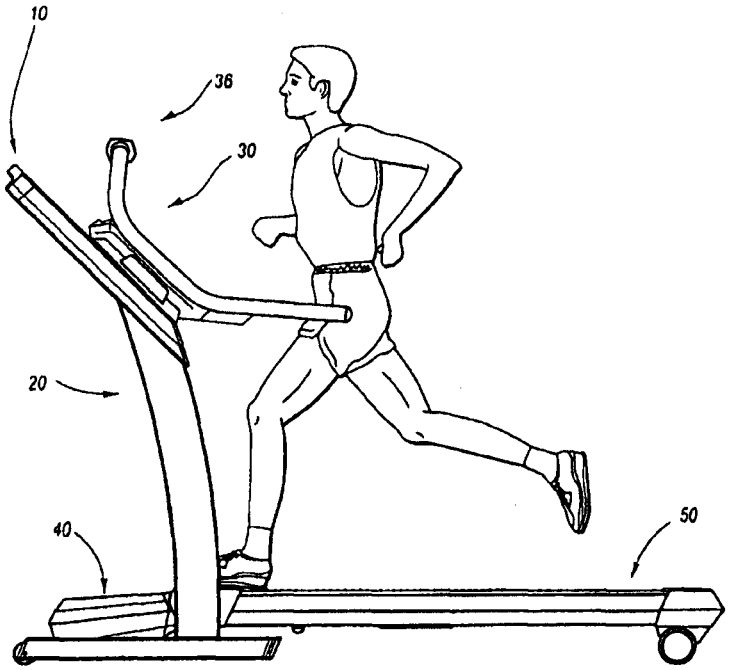

Signed and Sealed this

Fifteenth Day of June, 2010

David J. Kappos

David J. Kappos
*Director of the United States Patent and Trademark Office*

Replace Figure 2B with the figure depicted herein below, wherein "50" has been changed to --20--, "20" has been changed to --30--, "30" has been changed to --50--, and "36" has been added.
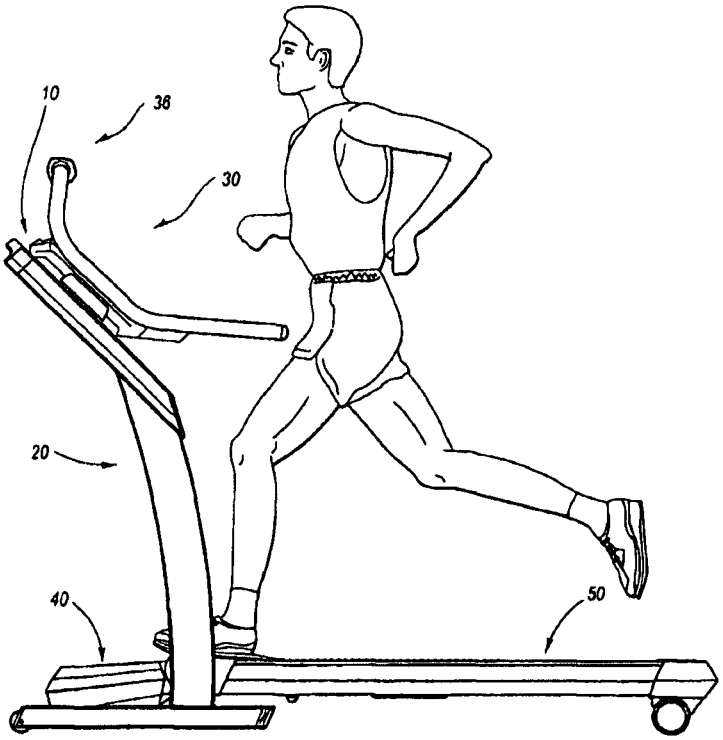
Replace Figure 4 with the figure depicted herein below, wherein "28" has been changed to --32--.
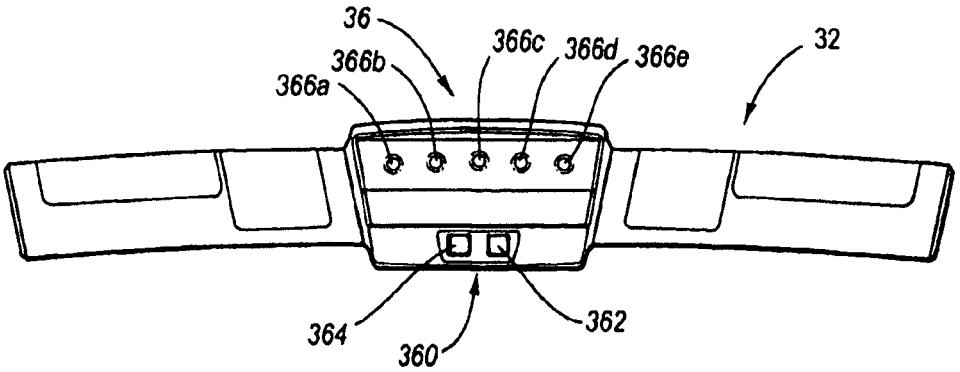

Replace Figure 7 with the figure depicted herein below, wherein the first instance of "50" from the left has been changed to --20--.

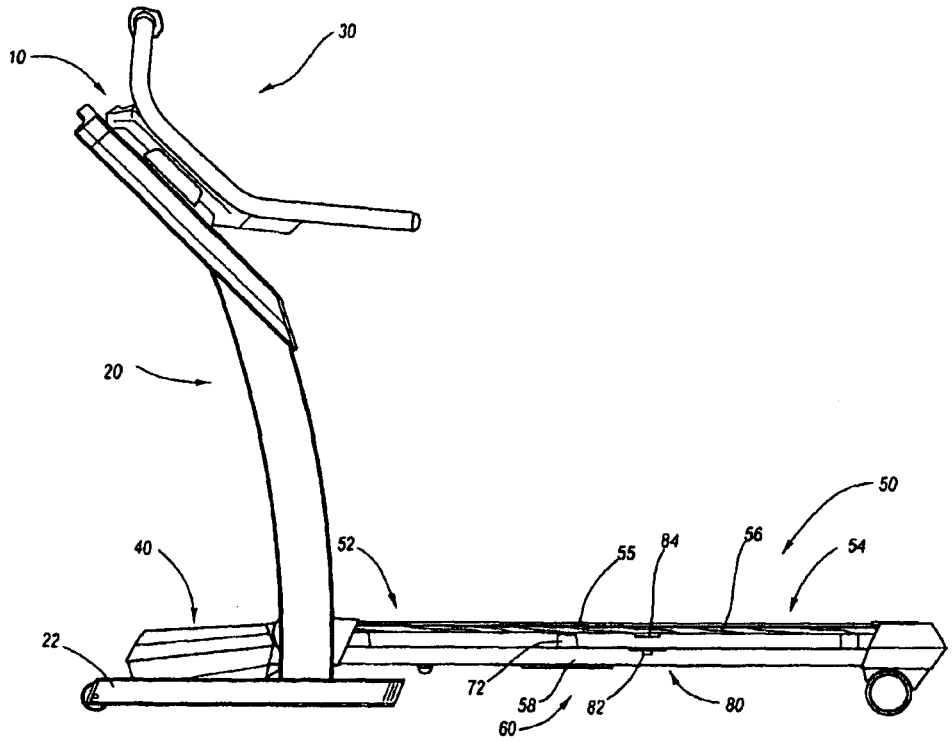

Column 1
Line 32, change "user.3" to --user.--.

Column 6
Line 15, change "excising" to --exercising--.
Line 25, change "cross-sectional" to --perspective--.
Line 27, change "motor 31" to --motor 282--.
Line 67, change "appreciated as" to --appreciated by--.

Column 7
Line 25, change "motor 382" to --motor 282--.
Line 28, change "motor 382" to --motor 282--.
Line 37, change "setting" to --settings--.
Line 38, change "motor 382" to --motor 282--.
Line 41, change "motor 382" to --motor 282--.

Column 8
Line 66, change “motor 382” to --motor 282--.

Column 9
Line 1, change “motor 382” to --motor 282--.
Line 2, change “console 380” to --console 30--.
Line 23, change “It is than” to --It is then--.
Line 42, change “ended in step 116” to --ended.--.

Column 11
Line 44, change “on tread” to --on the tread--.

Column 13
Line 9, change “potentiometer, or” to --potentiometer,--.
Line 10, change “sensor, a contact” to --sensor, or a contact--.
Line 14, change “mechanisms” to --mechanism--.
Line 47, change “members 76a, b” to --members 72a, b--.

Column 14
Line 21, change “controller 101” to --controller 104--.
Line 21, change “Controller 101” to --Controller 104--.
Line 26, change “pad 100” to --pad 102--.
Line 28, change “pad 100” to --pad 102--.
Line 32, change “pad 100” to --pad 102--.
Line 32, change “controller 101” to --controller 104--.
Line 56, change “controller 101” to --controller 104--.
Line 64, change “controller 101” to --controller 104--.

Claim 6
Column 15, line 53, change “when user” to --when the user--.
Column 15, line 54, change “on treadbase” to --on the treadbase--.

Claim 19
Column 16, line 28, change “of console” to --of the console--.

Claim 23
Column 16, line 49, change “detect height” to --detect the height--.